US006721966B2

(12) United States Patent
Costonde

(10) Patent No.: US 6,721,966 B2
(45) Date of Patent: Apr. 20, 2004

(54) TRANSFER BOARD

(76) Inventor: Sherry Costonde, 419 Tennyson Ave., Flint, MI (US) 48507

( * ) Notice: Subject to any disclaimer, the term of this patent is extended or adjusted under 35 U.S.C. 154(b) by 0 days.

(21) Appl. No.: 10/143,454

(22) Filed: May 9, 2002

(65) Prior Publication Data

US 2002/0166166 A1 Nov. 14, 2002

Related U.S. Application Data

(60) Provisional application No. 60/289,698, filed on May 9, 2001.

(51) Int. Cl.[7] ..... E03C 4/00; A47K 3/02

(52) U.S. Cl. ..... 4/661; 4/560.1; 297/DIG. 4

(58) Field of Search ..... 4/661, 560.1, 246.1, 4/254, 480, 483; 297/DIG. 4, DIG. 10, 115, 411.21, 411.23; 5/604, 84.1, 81.1 HS

(56) References Cited

U.S. PATENT DOCUMENTS

| | | | | | |
|---|---|---|---|---|---|
| 1,325,423 | A | | 12/1919 | Stuart | |
| 3,484,877 | A | | 12/1969 | Petersen | 5/86 |
| 3,758,894 | A | * | 9/1973 | Finley | 4/546 |
| 4,155,588 | A | * | 5/1979 | Danziger et al. | 297/115 |
| 4,287,619 | A | * | 9/1981 | Brewer et al. | 4/483 |
| 4,502,515 | A | * | 3/1985 | Kobayashi et al. | 141/195 |
| 5,067,188 | A | * | 11/1991 | Brantman | 5/81.1 HS |
| 5,282,284 | A | | 2/1994 | Brantman et al. | 5/81.1 |
| 5,373,591 | A | * | 12/1994 | Myers | 4/560.1 |
| 5,561,868 | A | * | 10/1996 | Campbell | 4/560.1 |
| 5,606,751 | A | * | 3/1997 | Baker | 4/560.1 |
| 5,802,632 | A | * | 9/1998 | Campbell | 5/81.1 C |
| 6,036,216 | A | | 3/2000 | Osborn | 280/304.1 |
| 6,397,410 | B1 | * | 6/2002 | Steadman | 4/561.1 |

OTHER PUBLICATIONS

Printout from www.westons.com website.
Printout from www.coast–resources.com website.
Printout from www.eldercorner.com website.
Printout from www.ilp–online.com website.
Printout from www.allmanproducts.com website.
Printout from accessibledesigns.com website.
Printout from www.sportaid.com website.
Printout from accessibilityproducts.com website.

* cited by examiner

*Primary Examiner*—Henry Bennett
*Assistant Examiner*—Amanda Flynn
(74) *Attorney, Agent, or Firm*—Gifford, Krass, Groh, Sprinkle, Anderson & Citkowski, P.C.

(57) ABSTRACT

A transfer board includes an upper transfer surface, a lower surface, a first end and a second end. A hook extends from the first end and is removably securable around an interior rim of a toilet seat or bowl. A latch extends from the lower surface of the transfer board proximate the first end to assist in securing the transfer board to the toilet seat.

16 Claims, 5 Drawing Sheets

TRANSFER BOARD

RELATED APPLICATION

This application claims priority of U.S. Provisional Patent Application Ser. No. 60/289,698 filed May 9, 2001, which is incorporated herein by reference.

BACKGROUND OF THE INVENTION

1. Field of the Invention

The present invention is directed to a transfer board. More particularly, the invention is directed to a transfer board that is adapted to be removably secured to a toilet or the like.

2. Reference to Related Art

It is sometimes necessary for physically handicapped individuals to utilize a device that assists them in carrying out daily tasks. One such device is the well-known wheelchair. Another such device is a transfer board. A transfer board, as the name implies, is used to create a bridge between two surfaces (e.g., between a bed and a wheelchair). Transfer boards are typically constructed to have a planar surface and a generally rectangular shape. However, the basic design has undergone a variety of modifications and improvements.

For example, U.S. Pat. No. 5,067,188 discloses a sliding transfer device that includes a lower support plate and an upper seat that is designed to slide across a top surface of the lower support plate. The lower support plate can be straight, curved or S-shaped.

Another reference is U.S. Pat. No. 4,287,619 that discloses a multipurpose chair for the partially disabled. The chair is adapted to be used over or as a toilet and includes armrests that may be utilized as transfer boards.

Still another reference is U.S. Pat. No. 6,036,216, which discloses a transfer board in combination with an armrest of a wheelchair. The combination of the armrest and transfer board allows unrestricted movement of the transfer board relative to the wheelchair while maintaining a linkage between the wheelchair and the transfer board.

Despite the variety and availability of transfer boards, the prior art does not disclose a transfer board that is designed to assist a physically handicapped person to transfer from a wheelchair, or other surface or device, over to a conventional toilet. Such a device would have the advantage of allowing the handicapped individual to utilize a conventional toilet facility without the need for a special chair or other outside aid.

SUMMARY OF THE INVENTION

The present invention concerns a transfer board having a body. The body of the transfer board includes an upper transfer surface, a lower surface, a first end and a second end. The body can be cast or molded in a number of shapes, such as a rectangle, bowed or arched or a v-shape. The upper transfer surface is smooth and can include a rib of a low friction material (e.g., ultra high density plastic).

A hook extends from the first end that is removably secureable to an interior rim of a toilet seat or bowl. The hook has an interior surface and can have a shape that is rounded or that of a squared bracket.

A latch extends from the lower surface of the body proximate the first end and can engage an exterior rim of the toilet seat or bowl such that it assists in securing the transfer board to the toilet seat or bowl. The latch can be constructed such that it is movable along a track and between first and second positions.

Finally, a biasing member that is adapted to engage an upper surface of a toilet seat or toilet bowl can be positioned on the interior surface of the hook.

BRIEF DESCRIPTION OF THE DRAWINGS

A better understanding of the present invention will be had upon reference to the figures, wherein like reference numerals refer to like parts throughout, and wherein.

DETAILED DESCRIPTION OF THE PREFERRED EMBODIMENTS

Figure 1:
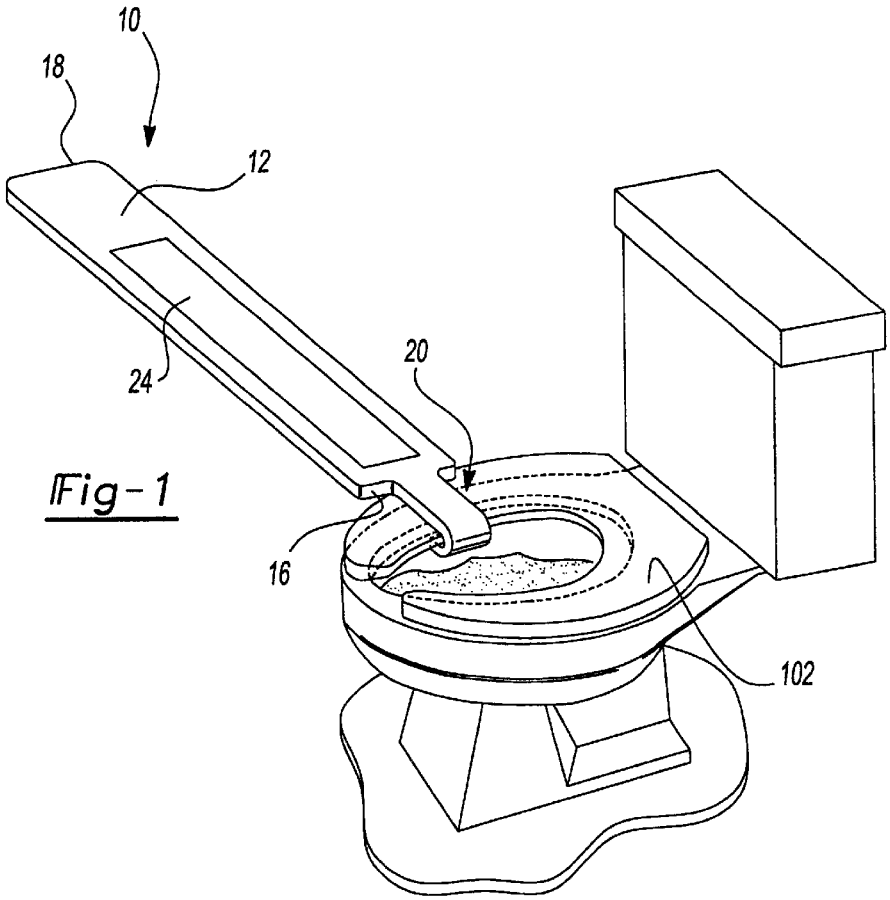
FIG. 1 is a perspective view of a preferred embodiment of a transfer board constructed in accordance with the present invention.
Figure 2:
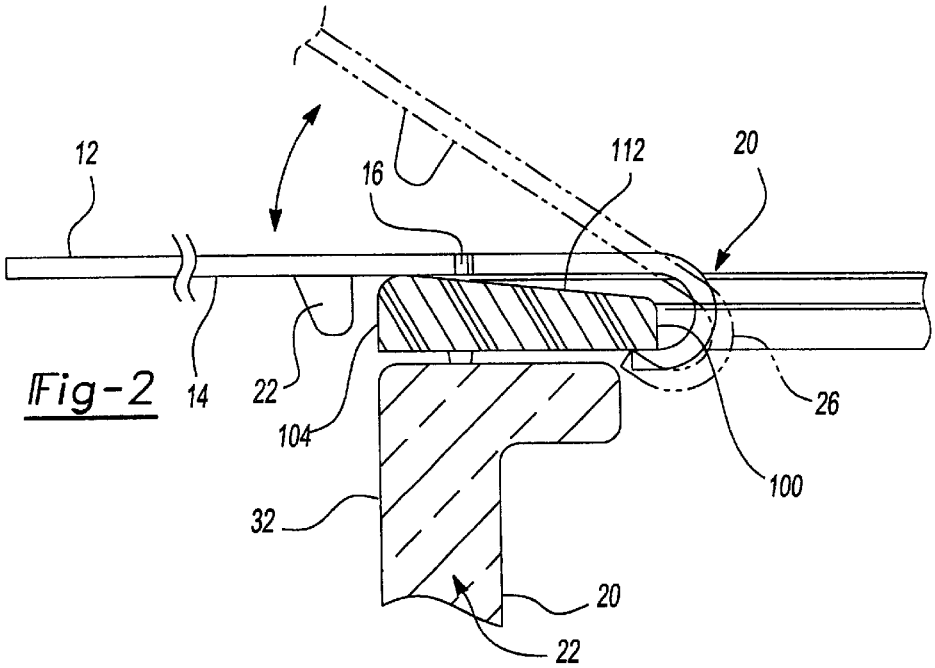
FIG. 2 is a side view of the transfer board shown in FIG. 1.

Referring now to FIGS. 1 and 2, there is shown a transfer board 10 constructed in accordance with a preferred embodiment of the present invention. The transfer board 10 includes an upper transfer surface 12, a lower surface 14, a first end 16 and a second end 18. A hook 20 extends from the first end 16 of the transfer board 10 and is securable around an interior rim 100 of a conventional toilet seat 102. A latch 22 extends from the lower surface 12 of the transfer board 10 proximate the first end 16 to assist in securing the transfer board 10 to the toilet seat 102.

Figure 3A:
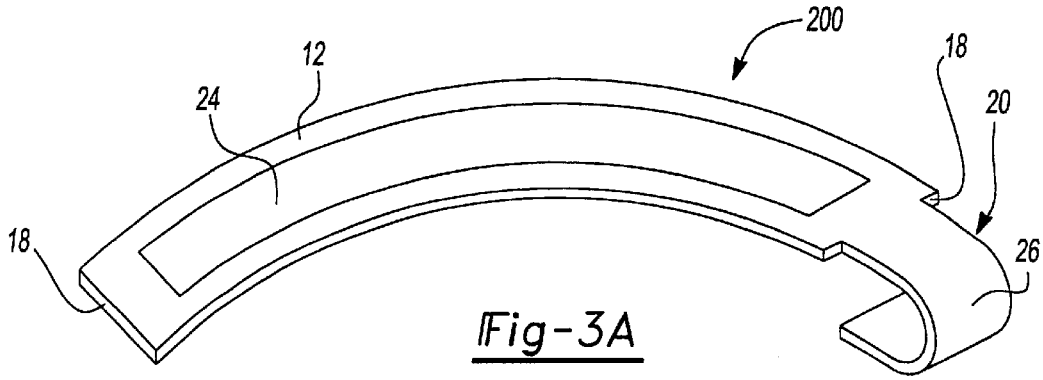
FIGS. 3A and 3B are first alternative embodiments showing the transfer board having a curved shape or a v-shape.
Figure 3B:
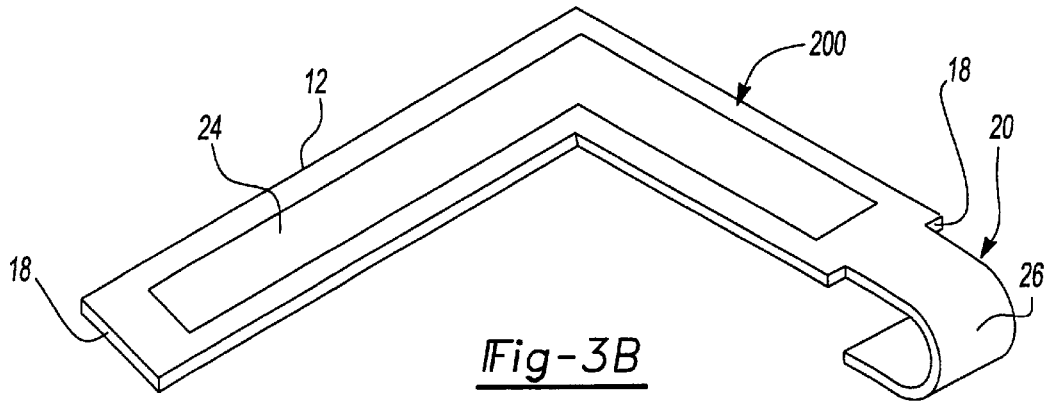

The transfer board 10 is preferably constructed of a moldable plastic. However, the transfer board 10 may also be constructed from a variety of other materials (e.g., polymers, alloys, metals or combinations thereof) and molded or cast into a variety of shapes (e.g., rectangular, bowed or arched, V-shaped, etc.). For example, referring to FIG. 3, there is shown a first alternative embodiment of a transfer board 200 that has a generally bowed or arched shape.

Still referring to FIGS. 1 and 2, the upper transfer surface 12 of the transfer board 10 is a smooth surface. Alternatively, the upper transfer surface 12 can include one or more ribs 24 of a low friction material such as an ultra high density plastic (UHDP).

The hook 20 extends from the first end 16 of the transfer board 10 and has a generally rounded exterior surface 26. However, as seen in FIGS. 4–9, the hook 20 can be constructed in a variety of forms including a squared bracket.

Still referring to FIGS. 1 and 2, the latch 22 extends from the lower surface 14 of the transfer board 10 proximate the first end 16 such that it is spaced a distance away from an exterior rim 104 of the toilet seat 102 when the hook 20 of the transfer bench 10 is secured around the interior rim 100 of the toilet seat 102. Alternatively, the latch 22 can be constructed to extend from the lower surface 14 such that it engages the exterior rim 104 of the toilet seat 102 when the hook 20 of the transfer bench 10 is secured around the interior rim 100 of the toilet seat 102.

Referring now to FIG. 2, in operation, an individual places the transfer board 10 either at an angle to or on the interior rim 102 and then engages the interior rim 100 with the hook 20 of the transfer board 10. The transfer board 10 is then lowered into a generally horizontal position such that the latch 22 and the hook 20 are secured about the rims 100, 104 of the toilet seat 102. Therefore, the latch 22 and hook 20 cooperate to inhibit the transfer board 10 from shifting or otherwise become disengaged from around the toilet seat 102 while the individual slides across the upper transfer surface.

Figure 4:
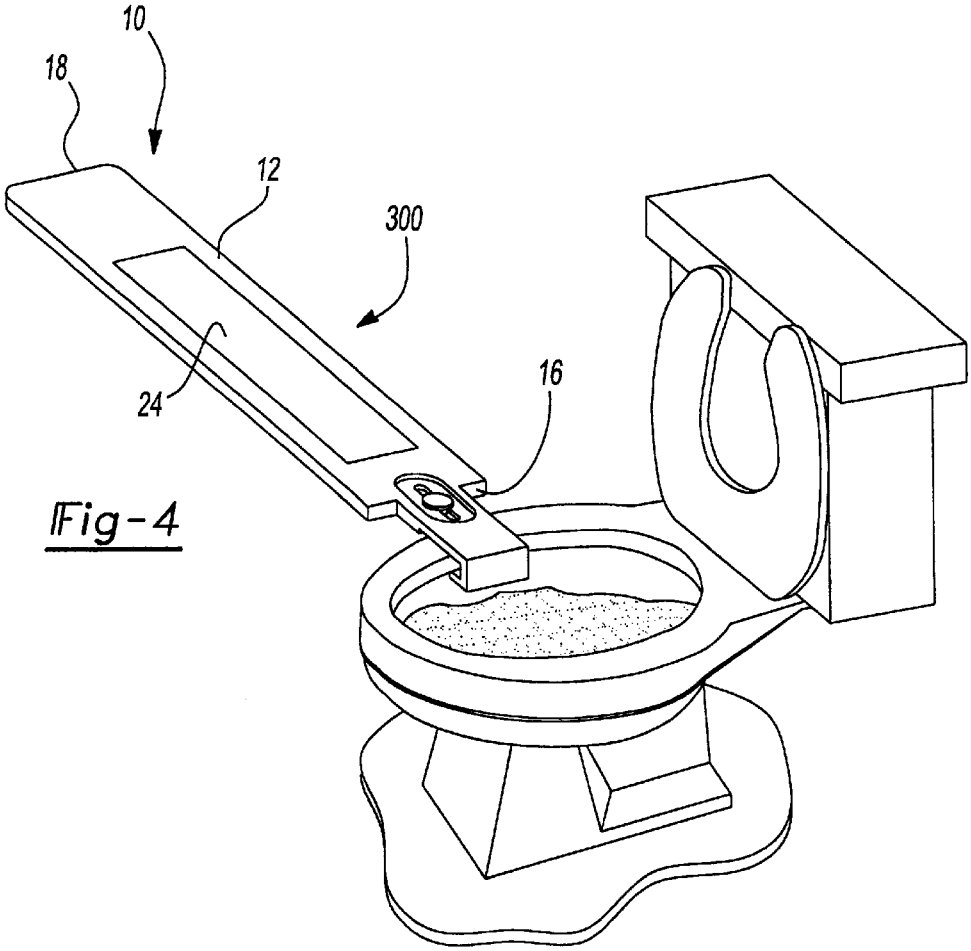
FIG. 4 is a perspective view of a second alternative embodiment showing a movable latch.
Figure 5:
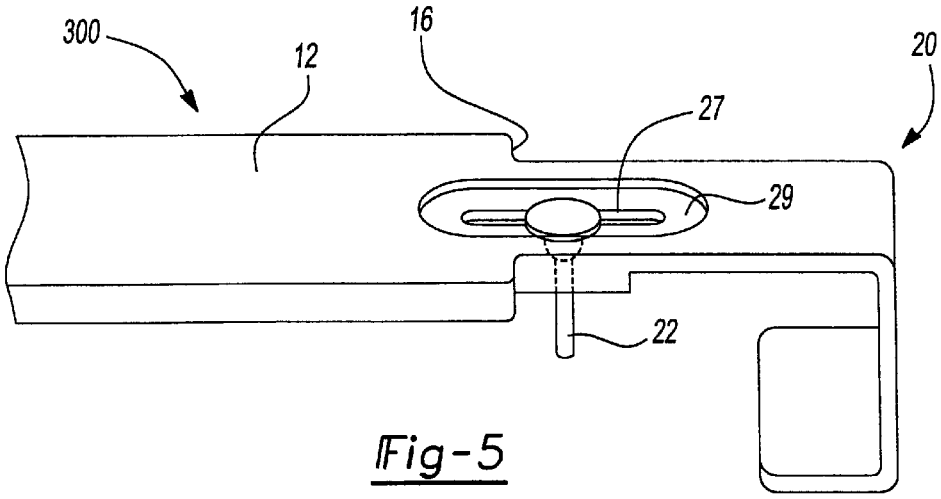
FIG. 5 is a side perspective view of the second alternative embodiment of a transfer board.

Referring now to FIGS. 4 and 5, there is shown a second alternative embodiment of the transfer board 300 of the present invention. As discussed above, the hook 20 of the transfer board 300 has a square or bracketed shape and is adapted to be secured around the interior rim 106 of a toilet bowl 108. However, it will be appreciated that the hook 20 of the transfer board 300 may also be secured around the interior rim 100 of a toilet seat 102. The latch 22 of the transfer board 300 is slidably secured within a channel 27 that is disposed in a recess 29 positioned in the first end 16 of the transfer board 300. In this manner, the position of the latch 22 can be moved between a first position and a second position so as to customize the fit of the transfer board 300 around the interior 106 and exterior 110 rim of the toilet bowl 108. It will be appreciated that the latch 322 of the transfer board 300 can be movably secured in the channel 27 by the use of a ratchet (not shown) or other mechanism that is well known in the art.

Referring now to FIGS. 6–9B, there are shown further alternative embodiments of the present invention. As with the above described embodiments, these further alternative embodiments include an upper transfer surface 12, a lower surface 14, and a first 16 and a second end 18. A hook 20 extends from the first end 16 and a latch 22 extends from the lower surface 14 proximate the first end 16 and includes a flexible neck portion 25. Additionally, a biasing member 30 is positioned on an interior surface 32 of the hook 20 and is adapted to engage an upper surface 112 of the toilet seat 102 or an upper surface 114 of the toilet bowl 108 when the transfer board is in position.

Figure 6:
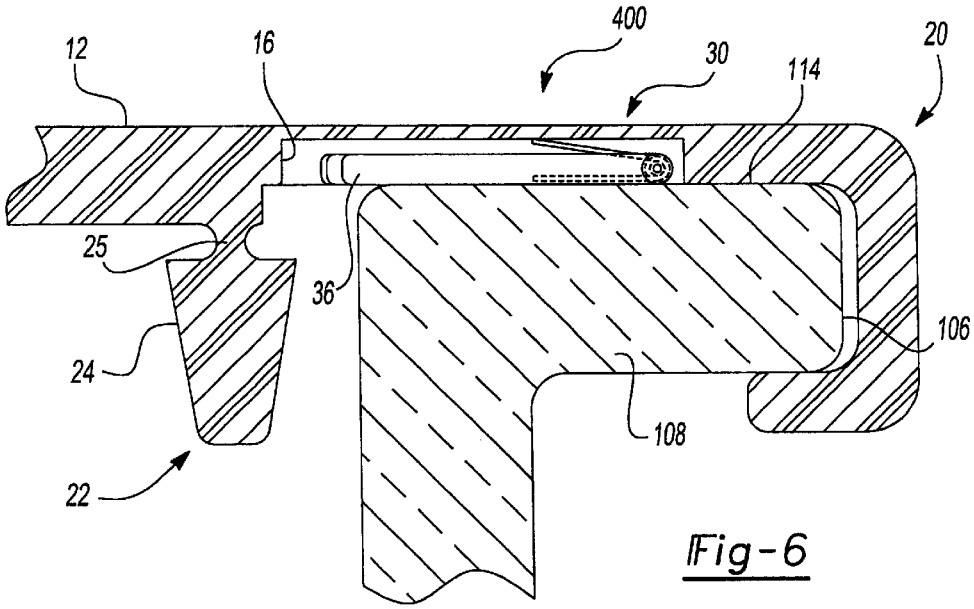
FIG. 6 is a side view of a third alternative embodiment of the present invention of a transfer board.
Figure 7:
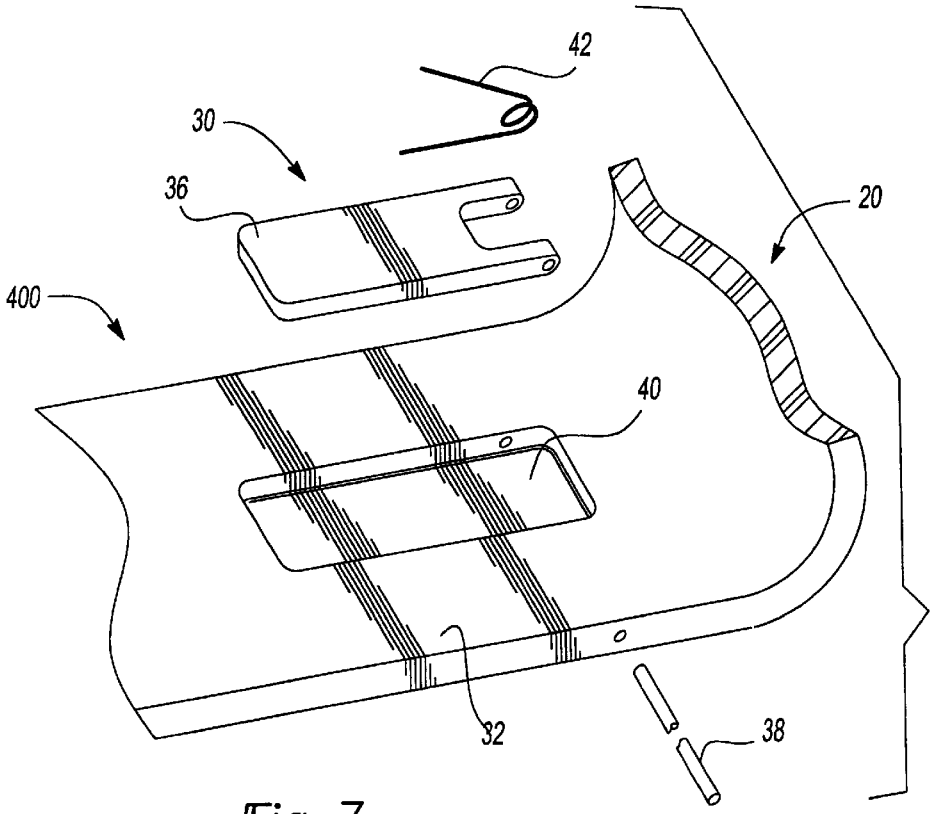
FIG. 7 is a perspective view of the third alternative embodiment of a transfer board.

Referring now to FIGS. 6 and 7, there is shown a third alternative embodiment of a transfer board 400 constructed in accordance with the present invention wherein the biasing member 30 includes a lever 36 that is pivotally secured by a pin 38 into a recess 40 that is disposed in the interior surface 32 of the hook 20. A coil spring 42 engages the lever 36 and the recess 40 (as is known in the art) to bias the lever 36 in an outward orientation.

Referring now to FIG. 6, when the transfer board 400 is in position around the seat 102 or rim 108 of toilet, the lever 36 is forced into the recess 40. Therefore, during a transfer of an individual from a first surface to the toilet, the weight of the individual will force the lever 36 into the recessed position. However, when the individual returns to the first surface, the lever 36 will assist in the removal of the transfer board through the lifting action of the coil spring 42.

Figure 8:
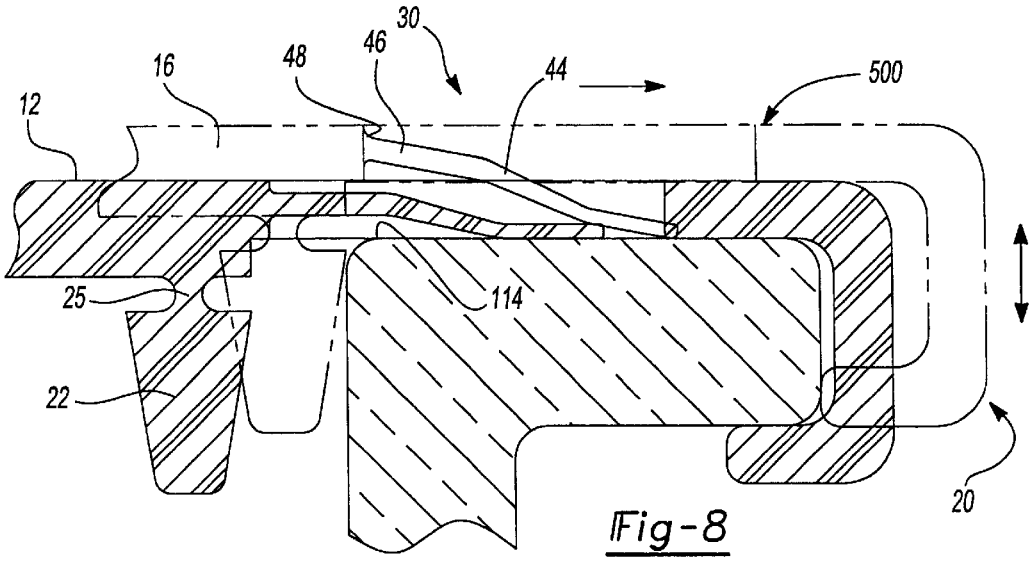
FIG. 8 is a side view of a fourth alternative embodiment of a transfer board.

Referring now to FIG. 8, there is shown a fourth alternative embodiment of a transfer board 500 constructed in accordance with the present invention wherein the biasing member 30 includes an elastic lever 44 having an end 46 affixed to a side surface 48 of the first end 16 of the transfer board 500. The elastic lever 44 extends into an interior area 50 of the hook 20 and is adapted to engage and apply a biasing pressure against the upper surface 112, 114 of the bowl 108 or toilet seat 102 to thereby assist in the removal of the transfer board 500.

Figure 9A:
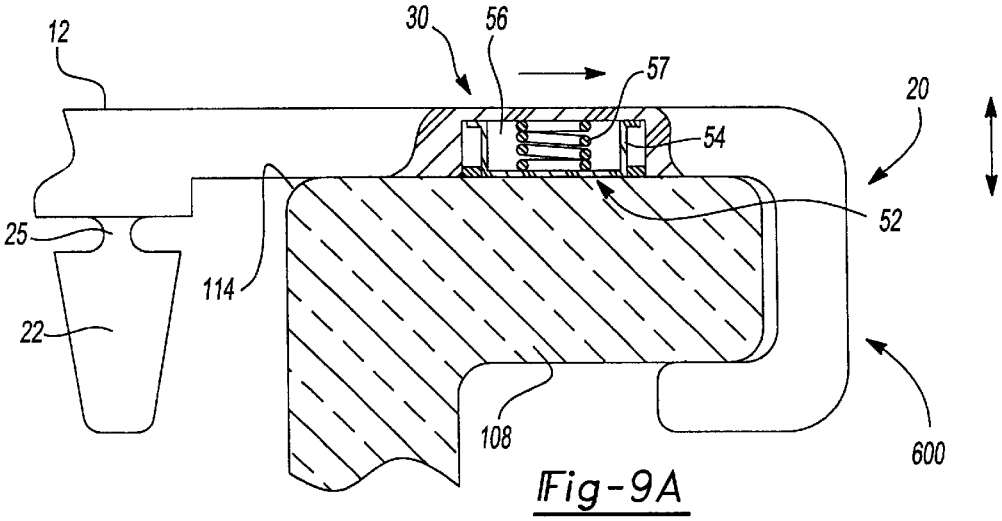
FIG. 9A is a side view of a fifth alternative embodiment of a transfer board secured around a toilet bowl.
Figure 9B:
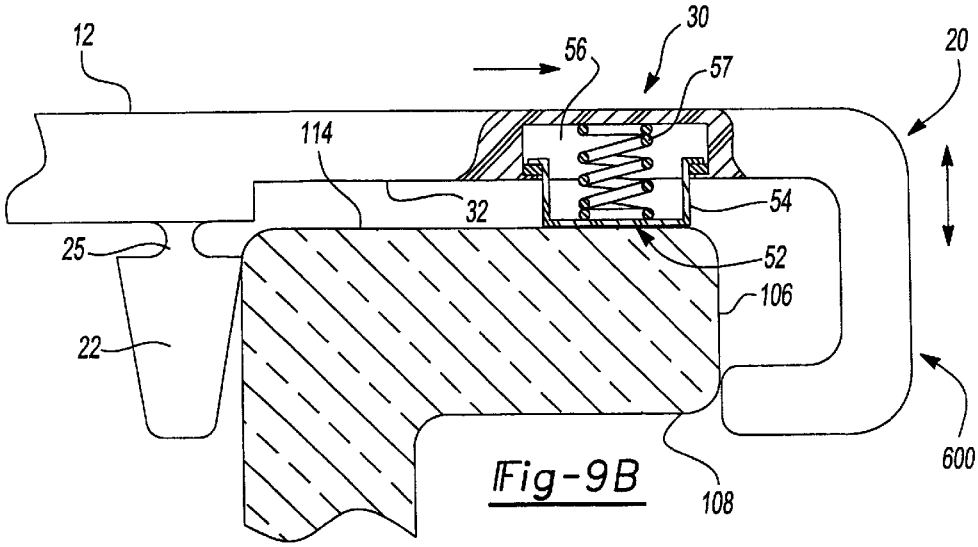
FIG. 9B is a side of the fifth alternative embodiment of a transfer board disengaged from around a toilet bowl.

Referring now to FIGS. 9A–9B, there is shown a fifth alternative embodiment of a transfer board construction in accordance with the present invention wherein the biasing member 30 includes a spring-biased button 52 positioned on the interior surface 32 of the hook 20. The button 52 includes a button cover 54 that is movably positioned in a recess 56 that is disposed in the interior surface 32 of the hook 20. A coiled spring 57 biases the button cover 54 in a downward position such that it applies a biasing pressure against the upper surface 112, 114 of the bowl 108 or toilet seat 102 to thereby assist in the removal of the transfer board 600.

Having thus described my invention, a person having skill in the art will be aware of various modifications and improvements that do not depart from the scope of the present invention.

I claim:

1. A transfer board for use with a toilet comprising, in combination:

a toilet; and a transfer board that is removably securable to the toilet, the transfer board including a body, a hook and a latch, the body having an upper transfer surface, a lower surface, a first end and a second end, the hook extending from the first end and being adapted to engage the toilet and having an interior surface and an exterior surface and the latch extending from the lower surface proximate the first end such that the latch assists in securing the transfer board to the toilet.

2. The transfer board of claim 1, wherein said transfer surface of said body further comprises a smooth surface.

3. The transfer board of claim 1, wherein said transfer surface of said body further comprises a rib of a low friction material.

4. The transfer board of claim 3, wherein said low friction material comprises an ultra high density plastic.

5. The transfer board of claim 1, wherein said body has an arched shape.

6. The transfer board of claim 1, wherein said body has a shape selected from the group consisting of: a rectangle, an arched shape or a v-shape.

7. The transfer board of claim 1, wherein said exterior surface of said hook is rounded.

8. The transfer board of claim 1, wherein said hook comprises a squared bracket.

9. The transfer board of claim 1, wherein said latch is movable between a first position and a second position.

10. The transfer board of claim 1, wherein said latch comprises a flexible neck portion.

11. A transfer board comprising:

a body having an upper transfer surface, a lower surface, a first end and a second end;

a hook extending from said first end that is removably securable to a toilet seat or bowl, said hook having an interior surface and an exterior surface;

a latch extending from said lower surface proximate said first end that assists in securing to said transfer board said toilet seat or bowl; and a biasing member positioned on said interior surface of said hook.

12. The transfer board of claim 11, wherein said biasing member comprises a lever pivotally secured to said interior of said hook.

13. The transfer board of claim 11, wherein said biasing member comprises a spring biased button.

14. The transfer board of claim 11, wherein said biasing member includes an elastic lever having an end affixed to a side surface of said first end of said body.

15. A transfer board comprising:

a plastic body having a smooth upper transfer surface, a lower surface, a first end and a second end, said smooth upper transfer surface of said body including a rib of ultra high density plastic;

a hook extending from said first end that is removably securable around an interior rim of a toilet seat, said hook having an interior surface;

a biasing member positioned on said interior surface of said hook and being adapted to engage an upper surface of said toilet seat when said hook is secured around said rim of said toilet seat; and a latch extending from said lower surface proximate said first end that assists in securing said transfer board of said toilet seat.

16. A transfer board for use with a toilet comprising in combination:

a toilet having a seat, the seat having an interior and an exterior rim; and a transfer board that is removably securable to the seat of the toilet, the transfer board including, a plastic body, a hook, and a latch, the body having an upper transfer surface, a lower surface, a first end and a second end, the hook extending from the first end and being adapted to engage the interior rim of the seat of the toilet and having an interior surface and a rounded exterior surface and the latch extending from the lower surface proximate the first end and being adapted to engage the exterior rim of the toilet seat.

* * * * *